US010690129B2

(12) United States Patent
Paulus et al.

(10) Patent No.: US 10,690,129 B2
(45) Date of Patent: Jun. 23, 2020

(54) METHOD AND CONTROL DEVICE FOR VARIABLE ROTATIONAL SPEED CONTROL OF A DISPLACEMENT PUMP UNIT AND DISPLACEMENT PUMP ARRANGEMENT

(71) Applicant: KSB Aktiengesellschaft, Frankenthal (DE)

(72) Inventors: Thomas Paulus, Schiffweiler (DE); Jochen Schaab, Nieder-Olm (DE)

(73) Assignee: KSB Aktiengesellschaft, Frankenthal (DE)

( * ) Notice: Subject to any disclaimer, the term of this patent is extended or adjusted under 35 U.S.C. 154(b) by 671 days.

(21) Appl. No.: 13/894,976

(22) Filed: May 15, 2013

(65) Prior Publication Data

US 2013/0251540 A1 Sep. 26, 2013

Related U.S. Application Data

(63) Continuation of application No. PCT/EP2011/070378, filed on Nov. 17, 2011.

(51) Int. Cl.
*F04B 49/06* (2006.01)
*F04D 15/00* (2006.01)
*F04B 49/12* (2006.01)

(52) U.S. Cl.
CPC ..... *F04B 49/065* (2013.01); *F04D 15/0088* (2013.01); *F04B 49/12* (2013.01);
(Continued)

(58) Field of Classification Search
CPC ..... F04B 49/00; F04B 49/06; F04B 49/065; F04B 49/08; F04B 2203/0207;
(Continued)

(56) References Cited

U.S. PATENT DOCUMENTS 5,448,149 A 9/1995 Ehsani et al.
6,468,042 B2 * 10/2002 Moller ..... F04B 49/065 417/44.11
(Continued)

FOREIGN PATENT DOCUMENTS

DE 196 30 384 A1 4/1998
DE 100 33 995 A1 1/2002
(Continued)

OTHER PUBLICATIONS

German Search Report dated Oct. 4, 2011 w/ partial English translation (nine (9) pages).
(Continued)

*Primary Examiner* — Peter J Bertheaud
(74) *Attorney, Agent, or Firm* — Crowell & Moring LLP

(57) ABSTRACT

A displacement pump arrangement, method for operating the displacement pump arrangement and a control device for controlling the displacement pump arrangement provide rotational-speed-variable control of an expeller pump unit for feeding a fluid. The arrangement includes an expeller pump and a drive, the drive being composed of an electric drive motor and a frequency converter, and a control device. The control device controls a state value such as a final pressure of the expeller pump a setpoint value. The control device detects state values of a control variable are supplied by the drive, in particular relating to the position, rotational speed and torque of the drive motor, and adjusts the displacement pump output to reach the setpoint value without using sensors.

4 Claims, 4 Drawing Sheets

(52) U.S. Cl.
CPC ..... *F04B 2201/1202* (2013.01); *F04B 2201/1208* (2013.01); *F04B 2203/0207* (2013.01); *F04B 2203/0209* (2013.01); *F04D 15/0066* (2013.01)

(58) Field of Classification Search
CPC ..... F04B 2201/1202; F04B 2201/1208; F04D 15/0066; F04D 15/0088
See application file for complete search history.

(56) References Cited

U.S. PATENT DOCUMENTS

| | | | | |
|---|---|---|---|---|
| 6,570,358 | B2 | 5/2003 | Nakatsugawa et al. | |
| 6,735,284 | B2 | 5/2004 | Cheong et al. | |
| 6,918,307 | B2 * | 7/2005 | Ohlsson | F04D 15/0088 415/17 |
| 2007/0071610 | A1 | 3/2007 | Holzemer et al. | |
| 2010/0143157 | A1 * | 6/2010 | Ahonen | F04D 15/0066 417/44.1 |
| 2012/0251340 | A1 * | 10/2012 | Ahonen | F04D 15/0088 417/53 |

FOREIGN PATENT DOCUMENTS

| | | | |
|---|---|---|---|
| DE | 103 41 106 | A1 | 5/2004 |
| DE | 20 2005 001 746 | U1 | 1/2006 |
| DE | 602 17 013 | T2 | 8/2007 |
| EP | 0 156 399 | A2 | 10/1985 |
| EP | 1 437 509 | A2 | 7/2004 |
| EP | 2 196 669 | A2 | 6/2010 |
| WO | WO 2005/050021 | A1 | 6/2005 |

OTHER PUBLICATIONS

International Search Report dated Apr. 18, 2012 w/ English translation (six (6) pages).
German-language Written Opinion (PCT/ISA/237) dated Apr. 18, 2012 (seven (7) pages).

* cited by examiner

METHOD AND CONTROL DEVICE FOR VARIABLE ROTATIONAL SPEED CONTROL OF A DISPLACEMENT PUMP UNIT AND DISPLACEMENT PUMP ARRANGEMENT

CROSS REFERENCE TO RELATED APPLICATIONS

This application is a continuation of PCT International Application No. PCT/EP2011/070378, filed Nov. 17, 2011, which claims priority under 35 U.S.C. § 119 from German Patent Application No. 10 2010 044 053.1, filed Nov. 17, 2010, the entire disclosures of which are herein expressly incorporated by reference.

BACKGROUND AND SUMMARY OF THE INVENTION

The invention relates to a method for the variable rotational speed control of a displacement pump unit for delivering a fluid, comprising a displacement pump and a drive, the drive comprising an electric drive motor provided with stator and rotor and a frequency converter, by a control device, a controlled variable of the displacement pump being controlled to a set point by the control device, and to a suitable control device for implementing the method and a corresponding displacement pump arrangement.

Displacement pumps are frequently used to deliver fluids, i.e., liquids or gases, at medium to high pressures and with small delivery rates. The drive usually employed is an asynchronous electric motor with upstream frequency converter in combination with a control device, formed as a process controller, for the variable rotational speed operation of the asynchronous motor. By the variable rotational speed operation together with a measurement of the final pressure as controlled variable of the displacement pump, control of the pressure at a variable delivery rate can be achieved. In addition to the actual control, the control device is usually additionally provided for open-loop control, monitoring and/or diagnostic tasks. The frequency converter and control device are usually implemented separately. In order to avoid overpressures and to dissipate pressures quickly, separate pressure relief valves are used on the pressure side in a conventional displacement pump arrangement. Because of the drive, starting up the drive against a closed slide valve is not possible without control actions by the pressure relief valve. Maintaining a required pressure at a delivery rate equal to zero, what is known as a zero delivery rate, is not possible in a conventional arrangement. As a result, the time needed to adjust the pressure as the slide valve is opened is prolonged.

Furthermore, a method is known for the sensorless control of rotor angular position or rotor position, called the position below for simplicity, and the rotational speed of a synchronous reluctance motor. Available as state values are rotational speed and position of the synchronous reluctance motor and, via the torque-forming current component, the torque of said motor.

The object of the invention is to devise a method for the variable rotational speed control of a displacement pump unit which increases the dynamics of the control and requires fewer individual components of the arrangement, and to provide a suitable control device for implementing the method and a corresponding displacement pump arrangement.

According to the invention, this object is achieved by a method in which, by the control device, at least one state value made available by the drive is registered, in particular torque and/or position of the drive motor, and, from this, the controlled variable of the displacement pump is determined by the control device, in order to control the displacement pump unit to the set point without the use of sensors. In particular, the final pressure and the required fluid volume are provided as controlled variables of the displacement pump. Advantageously, torque and position of the drive motor are registered as state values of the drive. In the method according to the invention, control to a set point is devised which manages entirely without any measurement of the controlled variable by sensors and is based purely on the state values supplied by the drive.

Furthermore, the control device is provided for open-loop control, monitoring and/or diagnostic tasks. In this application, without restricting the overall functionality of the device, the term control device will be used for simplicity. According to the invention, frequency converter and control device can also be implemented in an integrated manner.

One refinement of the method provides for the final pressure to be determined by the control device as controlled variable of the displacement pump, in order to control the displacement pump unit to the final pressure set point without using sensors. As a result, control to a final pressure set point is devised which manages without measurement of the final pressure by sensors.

According to a refinement of the invention, provision is made for the final pressure of the displacement pump to be controlled by a motor torque-final pressure dependency of the displacement pump unit that is stored in the control device. The control device and/or the drive implemented in an integrated manner with the control device is configured or matched to the respective displacement pump by such a pressure model. The final pressure of the pump is controlled via the control of the motor torque. The motor torque-final pressure dependency stored in the control device is provided in the form of a characteristic curve, a table of values or the like. In addition, a relationship in the form of a formula is provided and can be stored in a memory device provided in the control device. A simple linear relationship between motor torque and final pressure has proven to be expedient and adequate to a first approximation, said relationship being given by the actual value of the final pressure $p_{act}$, the actual value of the motor torque $M_{act}$, and the constant $k_1$ through the following equation:

$$P_{act}=k_1 \cdot M_{act} \quad \text{(Equation 1)}$$

For a precise determination of the final pressure, it has proven worthwhile that the rotational speed of the motor can additionally be registered by the control device. By such a dynamic pressure module, for the starting operation, the determination of pressure can be carried out while taking the dynamic torque component into account, formed from the product of the motor inertial constant θ and the derivative of the rotational speed $\omega_{act}$, in accordance with the following equation:

$$P_{act}=k_1 \cdot (M_{act}-\theta \cdot \omega_{act}') \quad \text{(Equation 2)}$$

Moreover, it has proven to be expedient to register state values, in particular position, rotational speed and torque, of a sensorless synchronous reluctance motor with flux barrier gap by the control device. The rotor angular position, also called position below, and rotational speed of a rotor of a synchronous reluctance motor that is provided with flux barriers or cutouts called flux barriers in the rotor lamination can be controlled without sensors. In addition to the state values comprising rotational speed and position of the synchronous reluctance motor, the torque of the motor with the torque-forming current component is also available. The rated torque of the sensorless synchronous reluctance motor is already available when the motor is at a standstill, so that, even in the case of a delivery rate of zero, the pressure can be kept at the required level. The method according to the invention in conjunction with the sensorless synchronous reluctance motor permits a displacement pump to be started up against a closed slide valve. The desired final pressure is immediately available in this case.

It is particularly advantageous that such a synchronous reluctance motor is controlled without rotational speed sensors and without position sensors. Thus, by using the method according to the invention, there is control to a final pressure set point which manages without any measurement of the final pressure by sensors and without any position or rotational speed sensors.

Additional advantages are provided by a refinement of the method according to which the position of the drive motor, that is to say the angular position of the drive rotor in relation to the drive stator, is registered by the control device and, by using the value of the sealed displacement pump volume, the stroke volume, the delivered fluid volume is determined. Here, the delivered fluid volume is given by the angular distance covered by the drive rotor and the stroke volume of the displacement pump. Thus, defined fluid volumes may be delivered by the method. Final pressure and delivered fluid volume of the displacement pump unit can thus be determined simultaneously.

Furthermore, by the combination of final pressure control and determination of the delivered fluid volume, incomplete filling of the displacement pump with the fluid to be delivered can be detected. As a result of detecting an incomplete filling that may possibly be present, a correct calculation of the delivered quantity can be carried out.

Provision is made here for a predefined fluid volume to be delivered the actual fluid volume determined being compared by the control device with the predefined fluid volume and, when the predefined fluid volume is reached, delivery operation of the displacement pump unit being stopped. To this end, for example beginning with a starting time, the delivery volume per piston stroke of the displacement pump is added up. When the predefined fluid volume is reached, the delivery operation of the displacement pump unit is stopped. To this end, a valve arranged on the pressure side can be activated by the control device and can be closed.

In a control device according to the invention for implementing the method according to the invention, a controlled variable of a displacement pump being controlled to a set point by the control device, provision is made for the control device to register at least one state value provided by the drive, in particular torque and/or position of the drive motor, and to have a memory device, for the control device to determine the controlled variable from the state value, in order to control the displacement pump unit to the predefined set point without using sensors and on the basis of the state values supplied by the drive. To this end, torque and position of the drive motor are expediently registered as state values of the drive. In particular, provision is made for the final pressure of the displacement pump to be used as controlled variable. This permits the control of the final pressure to the final pressure set point without pressure sensors. From the position information from the drive motor, it is possible to control to the controlled variable of delivered fluid volume.

According to an advantageous refinement, provision is made for a motor torque-final pressure dependency of the displacement pump unit to be stored in the memory device of the control device and for the control device to control the final pressure of the displacement pump by the motor torque-final pressure dependency of the displacement pump unit. The memory device is used to store the characteristic parameters or characteristic variables of the respective displacement pump. This is carried out in the form of a characteristic curve, a table of values, by a relationship in the form of a formula or the like. Expediently, a linear relationship between motor torque and final pressure in accordance with the above equation 1 is stored in the memory device.

Furthermore, the control device according to the invention is capable of using the position information from the drive motor, more precisely the angular position of the drive rotor, and the value of the sealed displacement pump volume, the stroke volume, to determine the fluid volume delivered and/or to control a predefined fluid delivery rate.

A displacement pump arrangement according to the invention, having a displacement pump unit for delivering a fluid, the displacement pump unit comprising a displacement pump and a variable rotational speed drive, the drive comprising an electric drive motor and a frequency converter, a controlled variable of the displacement pump, in particular final pressure and/or delivered fluid volume, being controlled, and possibly having a valve arranged on the pressure side, in particular a shut-off valve, is characterized by a control device according to the invention. If appropriate, the valve, in particular the shut-off valve, is actuated and/or controlled by the control device.

Advantageously, the drive motor of the displacement pump unit is a synchronous reluctance motor having flux barriers and operated without sensors. The rotor angular position and rotational speed of a synchronous reluctance motor that is provided with flux barriers can be controlled without sensors. Rotational speed, position and torque of the synchronous reluctance motor are available to the control device as state values. The rated torque of the sensorless synchronous reluctance motor is already available when the motor is at a standstill, so that, even with a delivery rate of zero, the pressure can be kept at the required level. By using the sensorless synchronous reluctance motor, even starting up the displacement pump unit against a closed slide valve is possible. The desired final pressure is immediately available in this case.

Here, it has proven to be expedient that the drive determines the position and the rotational speed of the drive motor without sensors. To this end, the drive measures electric voltages and/or electric currents of the drive motor.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
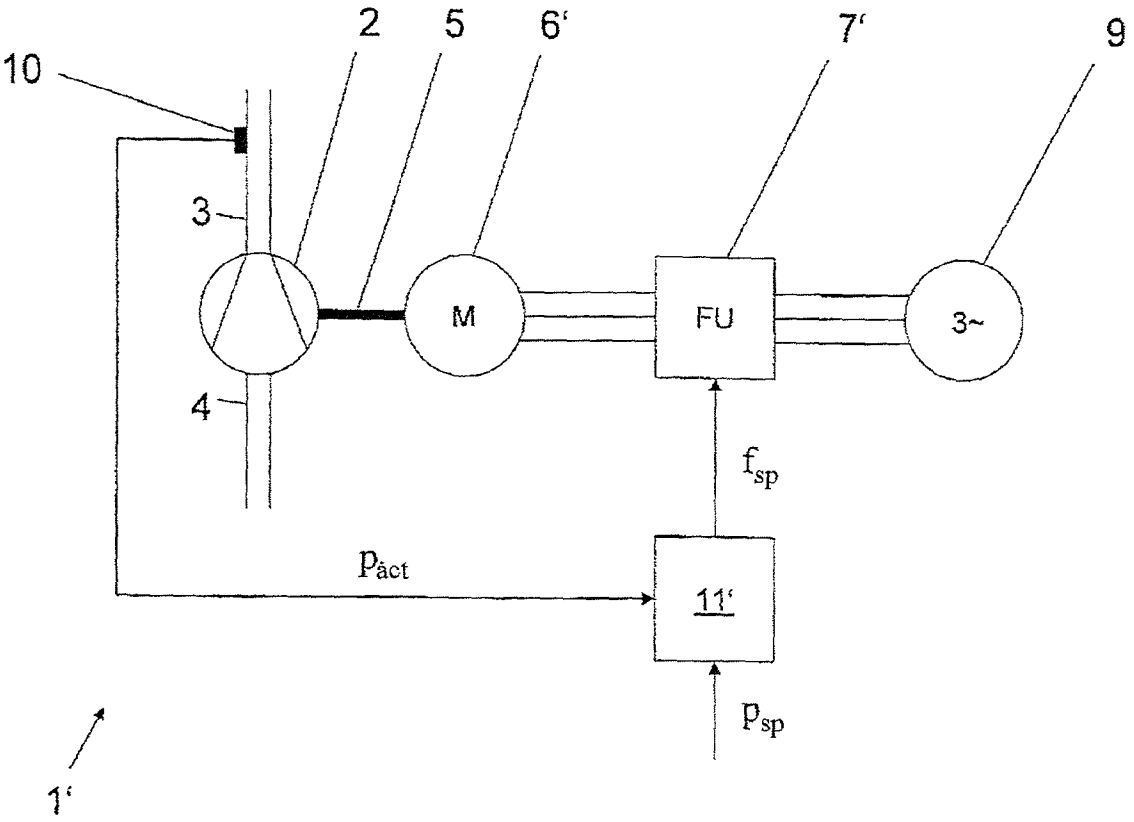
Fig. 1 Prior Art
FIG. 1 shows a displacement pump arrangement according to the prior art.

FIG. 1 shows a displacement pump arrangement 1' according to the prior art in a schematic illustration. A displacement pump 2 is connected on its pressure side 3 and on its suction side 4 to a pipeline system of a plant, not specifically illustrated, and is driven by a shaft 5 by an electric motor 6' comprising rotor and stator, here a conventional asynchronous motor. The electric motor 6' can be operated with a variable rotational speed and is supplied via a frequency converter 7' in a multi-phase manner, three-phase here, with a multi-phase, three-phase here, electric alternating voltage network 9. By a predefined frequency set point $f_{sp}$, the frequency converter 7' operates the electric motor 6' at a specific but variable rotational speed. Electric motor 6' and frequency converter 7' form the drive for the displacement pump 2. On the pressure side 3 of the displacement pump 2, by a pressure sensor 10, a signal in accordance with the final pressure $p_{act}$ of the arrangement 1' is registered and forwarded to a control device 11'. The control device 11' is used to control the final pressure $p_{act}$ of the displacement pump 2 to a predefined final pressure set point $p_{sp}$ by a frequency set point $f_{sp}$. In order to avoid overpressures and to dissipate pressure quickly in such a displacement pump arrangement 1', separate pressure relief valves, not illustrated here, are necessary on the pressure side. Maintaining the required pressure at a delivery rate equal to zero, what is known as the zero delivery rate, is not possible in this arrangement. The time for adjusting the pressure when opening a slide valve arranged on the pressure side, not illustrated here, is prolonged.

Figure 2:
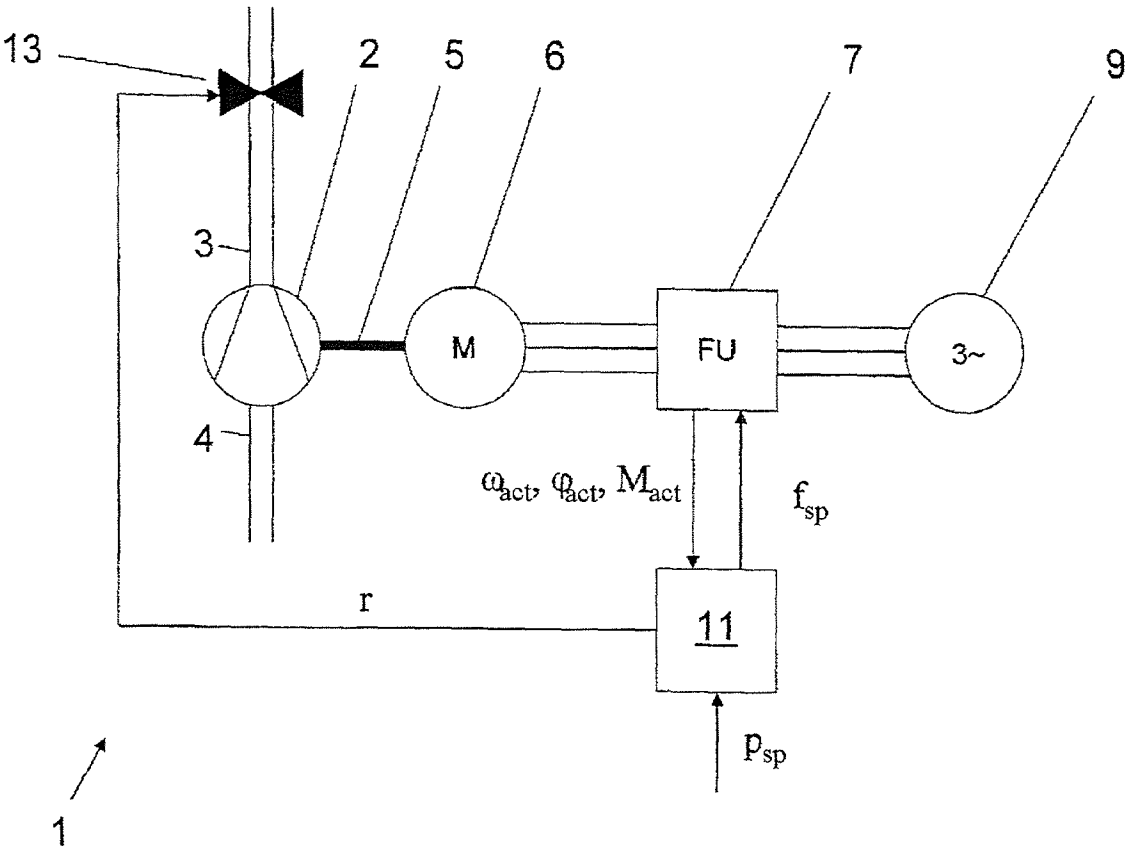
FIG. 2 shows a displacement pump arrangement according to an embodiment of the invention.

FIG. 2 shows a schematic illustration of a displacement pump arrangement 1 according to an embodiment of the invention having a displacement pump unit for delivering a fluid, which comprises a displacement pump 2 and a variable rotational speed drive. The drive is formed by an electric drive motor 6 provided with stator and rotor and a frequency converter 7. The electric motor 6 is connected via the frequency converter 7 in a multi-phase manner, three-phase here, to a multi-phase, three-phase here, electric alternating voltage network 9. A control device 11 controls the displacement pump 2 to a predefined final pressure set point. On the pressure side 3 of the displacement pump 2 there is arranged a valve 13, configured as a shut-off valve, for closing the pipeline on the pressure side. The control device 11 registers the motor state values comprising angular position $\Phi_{act}$, rotational speed $\omega_{act}$ and torque $M_{act}$ of the drive motor 6. The control device 11 has a memory device for the storage of parameters, dependencies and/or characteristic curves. The control device 11 determines the final pressure $p_{act}$ from the torque $M_{act}$ in order to control the displacement pump unit to the predefined final pressure $p_{sp}$ without using sensors. To this end, the control device 11 has the pressure controller 15 shown in FIG. 3 and explained in more detail, which generates a required frequency set point $f_{sp}$. According to the invention, as opposed to the prior art, neither a sensor signal of a pressure of the displacement pump nor another sensor is needed. According to the invention, the control device instead uses a motor torque-final pressure dependency of the displacement pump unit stored in the memory device of the control device 11, in order to control the final pressure $p_{act}$ of the displacement pump by the motor torque-final pressure dependency of the displacement pump unit. Furthermore, the control device 11 is able to determine the fluid volume delivered from the position information $\varphi_{act}$ from the drive motor 6 and a value of the sealed displacement pump volume, the stroke volume and/or to control a predefined fluid delivery rate. Via the actuating signal r, the control device 11 can actuate the shut-off valve 13 and open or close the same. In addition, with the aid of the rotational speed information $\omega_{act}$, the accuracy of the pressure determination is improved by the dynamic torque component being taken into account in the starting state.

Figure 3:
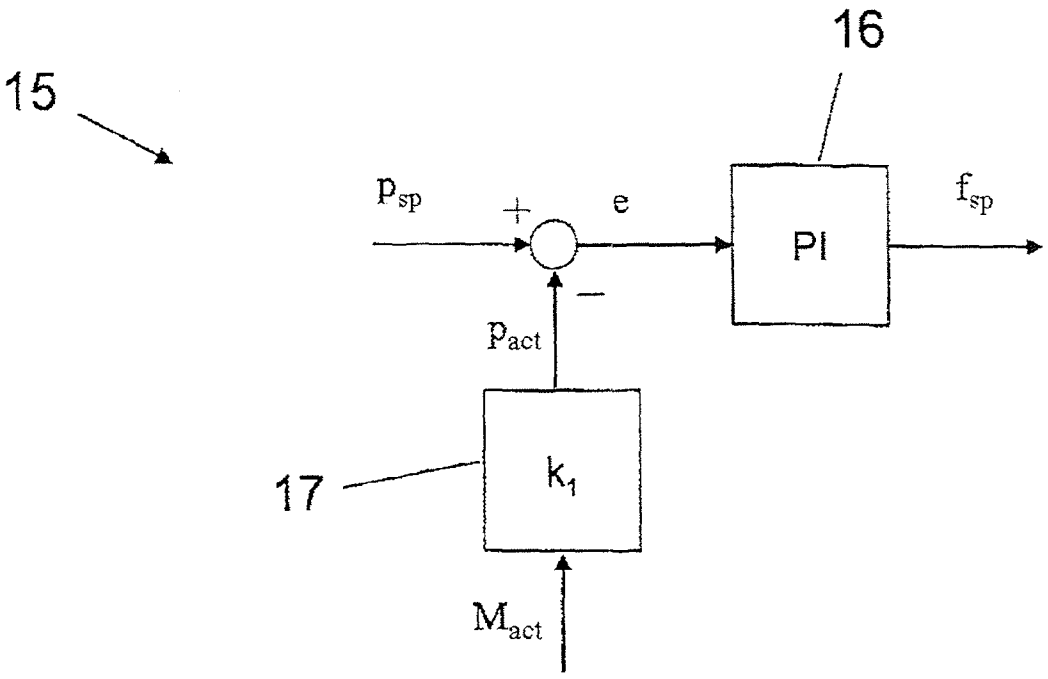
FIG. 3 shows a control engineering representation of a pressure control according to an embodiment of the invention.

FIG. 3 shows a control engineering representation of the mode of action of the pressure controller 15 according to the invention. The actual value of the displacement pump final pressure $p_{act}$ is given by $M_{act}$, according to a motor torque-final pressure dependency 17 stored in the memory device of the control device 11. In this exemplary embodiment, this dependency is approximated by a linear model and is given by the following formula together with the constant $k_1$:

$$p_{act}=k_1 \cdot M_{act} \quad \text{(Equation 1)}$$

According to the invention, further models 17 are provided, for example a pressure model which depicts the dynamic starting behavior according to the above equation 2. A control difference e between set point $p_{sp}$ and calculated controlled variable $p_{act}$ is fed to a controller 16, here a proportional-integral controller (PI controller), which calculates the required frequency set point $f_{sp}$ therefrom.

Figure 4A:
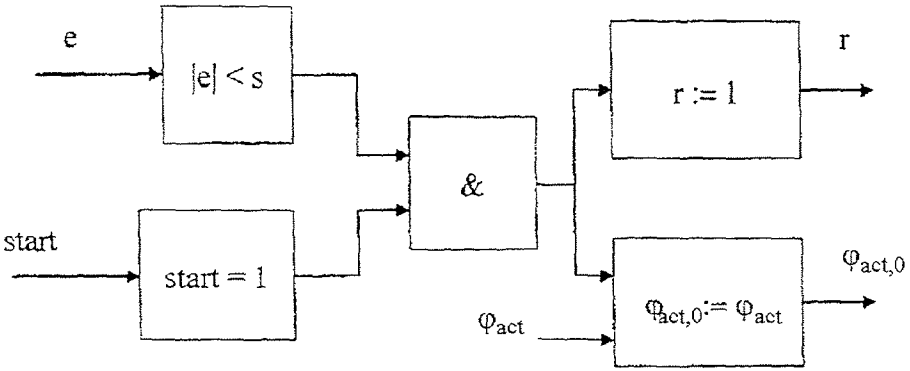
FIG. 4*a* shows a control engineering representation of a method sequence according to an embodiment of the invention with regard to initializing the fluid volume determination and valve opening.
Figure 4B:
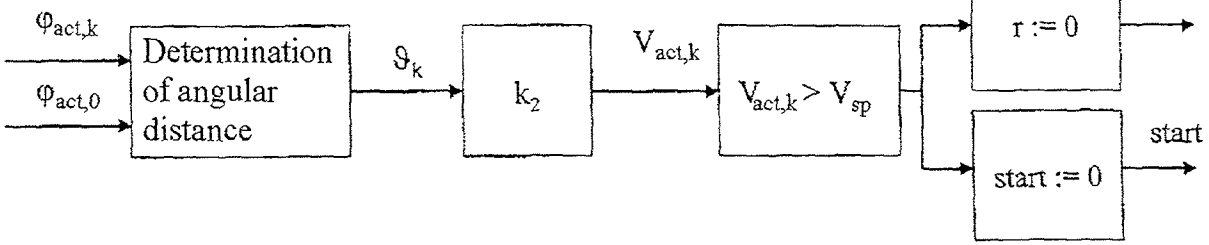
FIG. 4*b* shows a control engineering representation of a method according to an embodiment of the invention with regard to fluid volume determination and valve closure.

FIG. 4*a* shows a control engineering representation of a method sequence according to the invention for determining a delivered fluid volume in relation to the initialization and valve opening. FIG. 4*b* shows, in a corresponding way, the method sequence in relation to the actual volume determination and final valve closure. With a given starting condition ("start=1") and in the case of a control difference e lying below a threshold s, by an actuating signal r a valve 13 arranged on the pressure side 3 of the displacement pump 2 is opened and kept open for the start of a delivery with a defined fluid delivery volume $V_{sp}$. The condition, according to which the control difference e is to be below a specific threshold, ensures that the desired pressure level is built up before the delivery. In addition, by taking this starting condition into account, the determination of the volume is carried out under the assumption that the displacement pump is completely filled. For the purpose of initializing the determination of quantity, the initial angular position $\varphi_{act,0}$ is set to the actual value of the motor angular position $\varphi_{act}$. According to FIG. 4*b*, the delivered volume $V_{act}$, with $k_2$ as a factor, is given in accordance with the closed delivery volume of the displacement pump (stroke volume) as:

$$V_{act,k}=k_2 \cdot \theta_k \quad \text{(Equation 3)}$$

The determination of volume is carried out cyclically in successive iteration steps identified by index k, where $\theta_k$ represents the value of the entire angular distance swept over by the rotor. In the event that a predefined fluid delivery rate $V_{sp}$ has been reached ("$V_{act,k}>V_{sp}$"), the delivery operation is stopped ("start=0") and the shut-off valve 13 is closed ("r:=0"). By such a method, the control device according to the invention determines the fluid volume delivered from the position information $\varphi_{act}$ of the drive motor and the value of the sealed displacement pump volume, and is able to control to a predefined fluid delivery rate $V_{sp}$ at a predefined pressure.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for the variable rotational speed control of a displacement pump unit for delivering a fluid, the displacement pump unit including a displacement pump, a drive including an electric drive motor having a stator and a frequency converter, and a control device, comprising the acts of:

determining, using the control device, at least one state value of the drive based on drive motor electrical parameters, wherein the at least one state value includes the position of the drive motor and one or both of rotational speed and torque of the drive motor, the drive motor being a sensorless synchronous reluctance motor having a rotor with flux barriers;

determining, using the control device, from the at least one state value of the drive a value of a parameter of the displacement pump; and controlling, using the control device, the drive motor using the value of the parameter to control the displacement pump to reach a predetermined pump operation set point value, wherein the drive motor electrical parameters of the sensorless synchronous reluctance motor are obtained by the control device without drive motor rotational speed or position sensors, and the control device is configured to determine when the predetermined set point value is reached based on a relationship between a change in the position of the drive motor and an amount of change of the parameter per unit of position change.

2. The method as claimed in claim 1, wherein the parameter is a delivered fluid volume, the predetermined set point value is a final delivered fluid volume value, and the act of controlling the drive motor to reach the predetermined set point value includes operating the drive motor and comparing using the control device the delivered fluid volume with the final delivered fluid volume value and stopping operation of the displacement pump unit when the delivered fluid volume reaches the final delivered fluid volume value.

3. A control device for controlling a displacement pump and a drive including an electric drive motor provided with stator and rotor and a frequency converter, comprising:

a processing device; and a memory device, the control device being configured to use the processing device to determine at least one state value of the drive based on drive motor electrical parameters, wherein the at least one state value includes the position of the drive motor and one or both of rotational speed and torque of the drive motor, determine from the at least one state value a value of a parameter of the displacement pump, and control the drive motor using the value of the parameter to control the displacement pump to reach a predetermined pump operation set point value, wherein the drive motor is controlled with electrical parameters of the drive motor obtained by the control device without drive motor rotational speed or position sensors, and the control device is configured to determine when the predetermined set point value is reached based on a relationship between a change in the position of the drive motor and an amount of change of the parameter per unit of position change stored in the memory device.

4. A displacement pump arrangement, comprising:

a displacement pump for delivering a fluid, a variable rotational speed drive, the variable rotational speed drive including an electric drive motor provided with stator and rotor and a frequency converter, a control device, the control device including a processing device; and a memory device, the control device being configured to use the processing device to determine at least one state value of the drive based on drive motor electrical parameters, wherein the at least one state value includes the position of the drive motor and one or both of rotational speed and torque of the drive motor, determine from the at least one state value a value of a parameter of the displacement pump, and control the drive motor using the value of the parameter to control the displacement pump to reach a predetermined pump operation set point value, wherein the drive motor is controlled with electrical parameters of the drive motor obtained by the control device without drive motor rotational speed or position sensors, and the control device is configured to determine when the predetermined set point value is reached based on a relationship between a change in the position of the drive motor and an amount of change of the parameter per unit of position change stored in the memory device.

* * * * *